United States Patent [19]

Tagoku

[11] Patent Number: 4,628,017

[45] Date of Patent: Dec. 9, 1986

[54] ELECTROSTATIC IMAGE FORMING METHOD

[75] Inventor: Izumi Tagoku, Tokyo, Japan

[73] Assignee: Ricoh Company, Limited, Tokyo, Japan

[21] Appl. No.: 793,914

[22] Filed: Nov. 1, 1985

[30] Foreign Application Priority Data

| | | | |
|---|---|---|---|
| Nov. 2, 1984 | [JP] | Japan | 59-232003 |
| Nov. 2, 1984 | [JP] | Japan | 59-232002 |
| Nov. 2, 1984 | [JP] | Japan | 59-232001 |
| Nov. 2, 1984 | [JP] | Japan | 59-232004 |
| Nov. 2, 1984 | [JP] | Japan | 59-232005 |

[51] Int. Cl.[4] ..... G03G 13/044

[52] U.S. Cl. ..... 430/48; 355/3 TE

[58] Field of Search ..... 430/48; 355/3 TE

[56] References Cited

U.S. PATENT DOCUMENTS

| | | | |
|---|---|---|---|
| 3,653,891 | 4/1972 | Thourson et al. | 430/48 |
| 3,830,645 | 8/1974 | Zweig | 430/48 |
| 3,963,488 | 6/1976 | Brushenko | 430/48 X |

FOREIGN PATENT DOCUMENTS

| | | | |
|---|---|---|---|
| 55-73072 | 6/1980 | Japan | 430/48 |
| 56-57046 | 5/1981 | Japan | 355/3 TG |

*Primary Examiner*—Roland E. Martin

*Attorney, Agent, or Firm*—Oblon, Fisher, Spivak, McClelland & Maier

[57] ABSTRACT

An electrostatic image forming method for various kinds of image forming apparatuses. At an exposing step, a light image having a light quantity region greater than a predetermined quantity of light is projected to form on a dielectric layer of a dielectric recording medium a positive electrostatic image which has such a tendency that the surface potential or the amount of surface charge is comparatively small in a region in which the quantity of light is comparatively large. A full-surface exposing step using a predetermined quantity of exposing light is added to before or after the exposure to the light image, so that the total quantity of exposing light exceeds a predetermined quantity of light. The quantity of light of the light image is controllable to a larger one which provides a positive electrostatic image on the dielectric layer, or to a smaller one which provides a negative latent image. After an image has been formed, a predetermined period of time for adaptation is provided to ensure a potential contrast so that a positive electrostatic latent image may be formed under advantageous image forming conditions.

7 Claims, 24 Drawing Figures

ELECTROSTATIC IMAGE FORMING METHOD

BACKGROUND OF THE INVENTION

The present invention relates to an electrostatic image forming method applicable to various kinds of imaging apparatuses such as a copier, a facsimile apparatus, a printer and an instant camera.

Electrostatic image forming methods heretofore proposed include an electrostatic image transfer method which was developed by L. E. Walkup and the principle of which is disclosed in U.S. Pat. No. 2,825,814. An approach sharing the same principle as Walkup is disclosed in R. M. Schaffert "Electrophotography" and named "TESI Method No. 5". Another similar approach is taught in "SPSE (1974)" by R. L. Jepsen and G. F. Day of Varian Ass.

An image forming apparatus which employs such a prior art electrostatic image transfer method will be briefly described with reference to FIG. 1. As shown in FIG. 1, the apparatus includes a dielectric recording medium 10 made up of a transparent electrode layer 12 and a dielectric layer 14, and a photoconductive element 16 made up of an electrode layer 18 and a photoconductive layer 20. The recording medium 10 and the photoconductive element 16 are held in close contact with each other.. While a DC voltage Vo is applied across the electrodes 12 and 18 from a DC power source 22, a light image associated with a transmissive document 24 is projected from the dielectric layer 14 side so as to provide an electrostatic image on the layer 14. Specifically, among the areas which are exposed to the light, those in which the divided voltage between the photoconductive element 16 and the dielectric recording element 10 has exceeded the breakdown voltage in an air gap 26 between the elements 16 and 10 cause discharging to occur therein and, thereby, allow charges to be deposited on the dielectric layer 14, the charges constituting an electrostatic image. That is, the amount of charge deposited on the dielectric layer 14 depends upon the quantity of exposing light; charges develop in the irradiated portions to provide negative electrostatic images.

The above described type of image forming apparatus uses an inversion-development process because the negative image has to be changed to a positive image. Assuming that the recording medium 10 comprises an electrostatic recording paper, for example, it involves substantial microscopic irregularity due to the configuration of the dielectric layer 14 and the electrostatic characteristics. As reported in various fields in the past, such microscopic irregularity turns an external electric field constituted by the electrostatic image into a minute electric field which is generally referred to as a "microfield", thereby rendering the inversion development considerably difficult.

The prior art electrostatic image forming method as discussed above cannot provide positive images unless the document itself or the light images to be projected are negative. Hence, it is incapable of freely manipulating ordinary documents or the like in forming images.

SUMMARY OF THE INVENTION

It is therefore an object of the present invention to provide an electrostatic image forming method using the principle of electrostatic image transfer which is capable of providing stable positive electrostatic images on a dielectric recording medium, so that positive images may be reproduced without inversion development.

It is aother object of the present invention to provide an electrostatic image forming method using the principle of electrostatic image transfer which is capable of providing positive electrostatic images on a dielectric recording medium so that positive images may be reproduced without resorting to inversion development, and of freely providing negative electrostatic images whenever desired or depending upon the document and other factors.

It is another object of the present invention to provide a generally improved electrostatic image forming method.

An electrostatic image forming method of the present invention is applicable to an image forming apparatus which is provided with a photoconductive element having an electrode layer and a photoconductive layer, and a recording medium having at least a dielectric layer, at least one of the photoconductive element and the recording medium having transmissivity. The method comprises the steps of (a) causing the photoconductive layer of the photoconductive element and the dielectric layer of the recording medium to face and make close contact with each other with the intermediary of an air gap, (b) applying a DC voltage across the electrode layer of the photoconductive element and the dielectric layer of the recording medium, (c) projecting a light image for exposure from a back of one of the photoconductive element and the recording medium which has transmissivity, and (d) controlling a light quantity of the light image. A positive electrostatic image or a negative electrostatic image is formed on the dielectric layer of the recording medium.

In accordance with the present invention, an electrostatic image forming method for various kinds of image forming apparatuses is disclosed. At an exposing step, a light image having a light quantity region greater than a predetermined quantity of light is projected to form on a dielectric layer of a dielectric recording medium a positive electrostatic image which has such a tendency that the surface potential or the amount of surface charge is comparatively small in a region in which the quantity of light is comparatively large. A full-surface exposing step using a predetermined quantity of exposing light is added to before or after the exposure to the light image, so that the total quantity of exposing light exceeds a predetermined quantity of light. The quantity of light of the light image is controllable to a larger one which provides a positive electrostatic image on the dielectric layer, or to a smaller one which provides a negative latent image. After an image has been formed, a predetermined period of time for adaptation is provided to ensure a potential contrast so that a positive electrostatic latent image may be formed under advantageous image forming conditions.

The above and other objects, features and advantages of the present invention will become more apparent from the following detailed description taken with the accompanying drawings.

DESCRIPTION OF THE PREFERRED EMBODIMENTS

While the electrostatic image forming method of the present invention is susceptible of numerous physical embodiments, depending upon the environment and requirements of use, substantial numbers of the herein shown and described embodiments have been made, tested and used, and all have performed in an eminently satisfactory manner.

Some embodiments of the present invention will be described with reference to FIGS. 2–15.

Generally, the image forming process is made up of an exposing step, a developing step and a fixing step. Among the three consecutive steps, the developing step may be implemented with any of known dry-process and semimoist-process methods and any of known one-component, two-component and other developers. The fixing step, too, may be implemented with any of various methods known in the art, e.g. heating, pressurizing, spraying, and natural drying. The gist is that the developing step and the fixing step need only be those which fulfill system requirements. The exposing step, on the other hand, is the step which constitutes the subject matter of the present invention. Specifically, the exposing step in accordance with the present invention is capable of producing a positive electrostatic image, instead of a negative one, from the same document depending upon the quantity of exposing light and other conditions, that is, effecting exposure and electrostatic image transfer at the same time. Details of such an exposing step will be discussed hereinafter.

Figure 1:
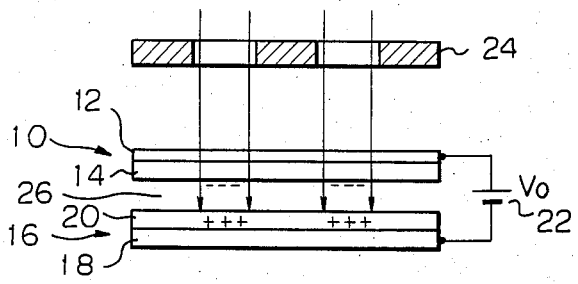
Fig. 1 PRIOR ART
FIG. 1 is a section of an image forming apparatus which uses a prior art electrostatic image transfer method.
Figure 2:
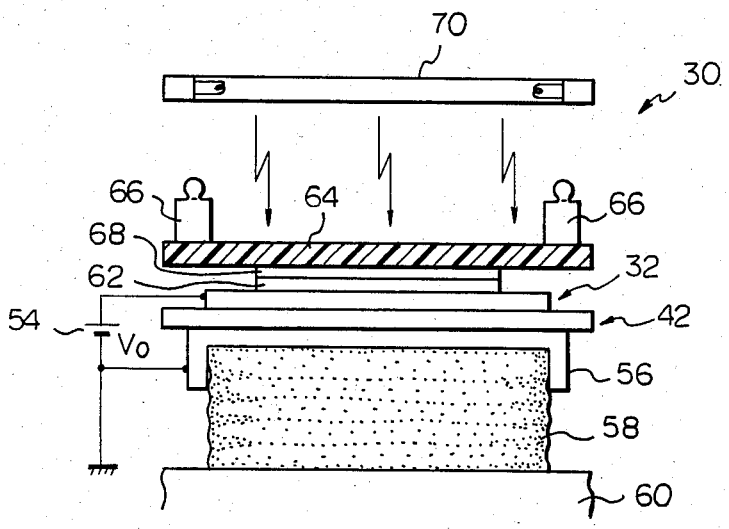
FIG. 2 is a schematic side elevation of an experimental apparatus to which the present invention is applied.
Figure 3:
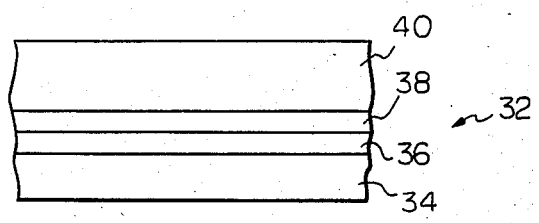
FIG. 3 is an enlarged section of a photoconductive element included in the apparatus of FIG. 2.
Figure 4:
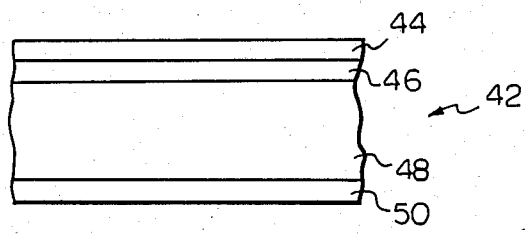
FIG. 4 is an enlarged section of an electrostatic recording paper also included in the apparatus of FIG. 2.

Referring to FIG. 2, an experimental apparatus useful for describing the exposing step in accordance with the present invention is shown. The illustrative apparatus is basically similar to the prior art arrangement of FIG. 1. The apparatus, generally 30, uses a photoconductive element 32 which comprises a generally transmissive organic photoconductor (OPC). Specifically, as shown in FIG. 3, the element 32 consists of a charge transfer layer 34, a charge generation layer 36, an electrode layer 38, and a base layer 40. The base layer 40 comprises a 100 microns thick polyethylene phthalate film (Myler film). The electrode layer 38 comprises an aluminum film which shows transmission of 35% to light having a wavelength of 600 nanometers. The charge generation layer 36 which is applied to the electrode layer 38 is made of a composition prepared by dispersing in butyral resin XYHL (UCC) a bis-azo pigment which is represented by a formula:

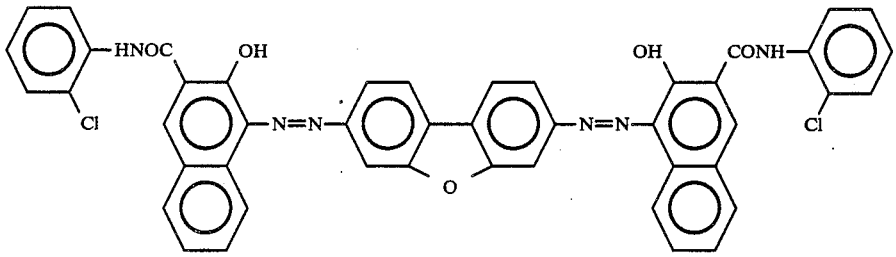

Here, the ratio of the pigment to butyral is 2.5/1 in terms of solids; the dispersion is prepared by processing the components for 24 hours in a ball mill with 1.1 wt% of solids. For the dispersion, a solvent having a THF/ethylcelsolve ratio of 4/6 is used. The layer 36 is applied to a thickness of about 0.2 microns. This thickness is equivalent to transmission of 10% at the absorption peak wavelength of 583 nonometers of the pigment. The charge transfer layer 34 which is deposited on the layer 36 is made of a composition obtained by solving in polycarbonate resin C-1400 (Teijin) a charge transfer agent CTM of styryl derivative (triphenylamine styryl) which has the following structure:

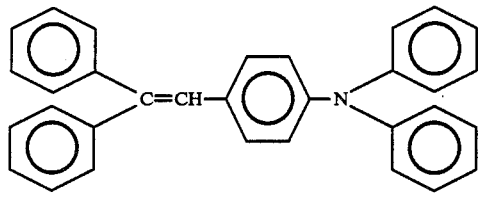

Here, the CTM to polycarbonate ratio is 9/10 in terms of solids and the content of solids is 20 wt%. A solvent used for the above purpose is THF (tetrahydrofuran). The layer 34 so deposited is measured 20 microns thick.

An electrostatic recording paper 42 is used as a dielectric recording medium. As shown in detail in FIG. 4, the paper 42 has a four-layer structure made up of a dielectric layer 44, a prelayer 46, a base 48, and a back layer 50. The base 48 comprises a 70–80 microns thick base paper and provided with conductivity by dispersing ECR-77 (Dow Chemical) in methanol (solvent) to impregnate the base paper with a conductive material. The prelayer 46 and the back layer 50 respectively are provided on the opposite surfaces of the base 48 by dissolving CR-77 (conductor) (Dow Chemical), vinyl acetate emulsion (binder) and clay (pigment) and applying the resluting composition to the base 48. The layers 46 and 50 are each about several microns thick. The dielectric layer 44 which is applied to the prelayer 46 comprises a dispersion of vinyl chloride (not greater than 1 micron in diameter) in putyral resin. The dielectric layer 44 is about 7 microns in average thickness and roughened at micron order over the surface thereof.

The photoconductive element 32 and the recording paper 42 are held in intimate contact with each other in such an orientation that the charge transfer layer (photoconductive layer) 34 and the dielectric layer 44 face each other. The micron-order roughening provided on the surface of the dielectric layer 44 as previously mentioned is to leave an air gap 52 between the facing layers 34 and 44, that is, to sufficiently reduce noise due to discharging and others which will be entailed by separation of the paper 42 from the photoconductive element 32 after formation of an electrostatic image (see FIG. 8). A DC voltage Vo is applied across the photoconductive element 32 and the paper 42 from a DC voltage source 54. For this purpose, one end of the power source 54 is connected to the electrode layer 38 of the element 32. Concerning the paper 42, although the conductive base 48 and the like may be directly connected to the power source 54 to serve as an electrode layer, it is more desirable for completeness to keep an aluminum foil electrode 56 in close contact with the back of the paper 42 and connect the electrode 56 to the other terminal of the power source 54.

The photoconductive element 32 and the recording paper 42 are positioned on a sponge mat 58 which is laid on a table 60. A transmissive original document 62 is disposed on the element 32. Weight is applied to the element 32 and paper 42 by a glass platen 64 and weights 66. The weight is measured about 26 $gW/cm^2$. A neutral filter 68 may be interposed between the glass platen 64 and the document 32 according to requirement. A ligh source 70 is located above the glass platen 64 for exposure.

Figure 5:
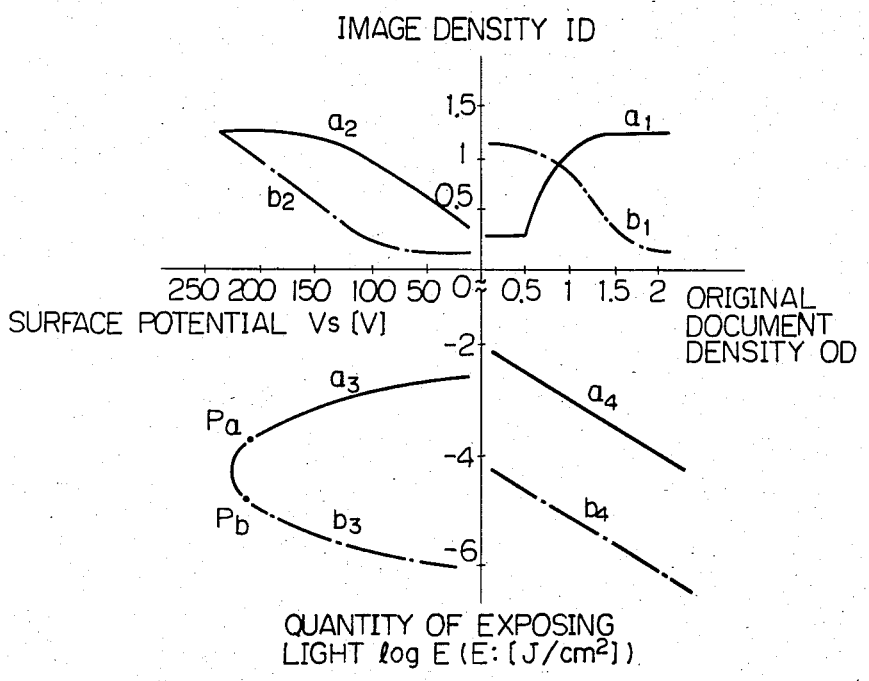
FIG. 5 shows various characteristic curves which are representative of the results of experiments.
Figure 6:
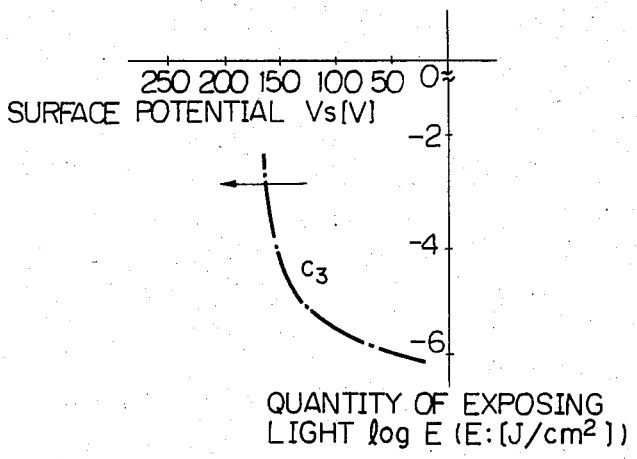
FIG. 6 shows a characteristic curve resulted from lowering DC voltage.

Referring to FIG. 5, there are shown the results of experiments which were conducted by use of the above-described apparatus and a DC voltage Vo of 650 volts. In FIG. 5, the fourth quadrant shows a relationship between the density of the original document 62 and the quantity of exposing light incident to the back of the element 32, the latter being obtained by applying a predetermined quantity of light over two alternative durations ($a_4$ and $b_4$). The third quadrant shows a a relationship between the quantity of exposing light and the surface potential which remains deposited on the paper 42 after the separation of the element 32 and the paper 42 in relation to the application of the voltage of 650 volts. While the curve shown in the third quadrant generally is a curve of secondary degree, it has been confirmed that varying the kind of the paper 42, for example, shifts the inclination and peak of the curve within the third quadrant. It is to be noted that the curve in the third quadrant is represented by a solid line $a_3$ and a dash-and-dot line $b_3$ to merely illustrate its correspondence with the two lines $a_4$ and $b_4$ which are shown in the fourth quadrant. That is, the curve in the third quadrant holds true with any quantity of exposing light E which is expressed as $E=Eo\times t$, where Eo is the quantity of radiation and t the duration of exposure.

The second quadrant in FIG. 5 shows a correlationship between the surface potential Vs and the image density ID which was obtained by developing a surface potential deposited on the recording paper 42 using a commercially available developing unit FT 4060 and a developing bias potential of 150 volts and, then, fixing the developed image by means of a commercially available fixing unit LP-4120. It has been found that the tendency shown in the second quadrant is substantially unchanged when cascade development, semimoist development or the like is used as a developing method and radiation fixing, natural drying or the like as a fixing method. The two curves $a_2$ and $b_2$ in the second quadrant appear respectively in correspondence with the ranges $a_3$ and $b_3$ which are shown in the third quadrant.

Consequently, the image density ID varies as represented by curves $a_1$ and $b_1$ with respect to the document density OD as shown in the first quadrant of FIG. 5. Specifically, where the quantity of exposing light log E is applied to the document under predetermined conditions as represented by the curve $a_4$, a positive electrostatic image appears on the dielectric layer 44 of the paper 42 according to the curve $a_3$ and is then developed without inversion as represented by the curve $a_2$. This provides a positive-to-positive image as indicated by the curve $a_1$. In contrast, where the quantity of light log E is applied as represented by the curve $b_4$ and inversion development is not performed, the resulting image is a negative-to-positive image as indicated by the curve $b_1$.

The images represented by the curve $a_1$ have the following characteristics. To begin with, in the case where a potential on the dielectric layer 44 as represented by the curve $b_3$ is developed by inversion, the inversion itself is extremely difficult due to the influence of microfield as discussed in relation to the prior art techniques and; it is almost impossible to accomplish uniformly inverted images should the document include line images and solid images. Further, as described later in detail, the prior art approaches in explaining the mode in the third quadrant consider a model in which the charges on the dielectric layer 44 migrate and, presumably as a result thereof, involve irregularity in image due to microscopic irregularity in electrostatic characteristic of the paper 42 in the medium density region indicated by the curve $b_2$. In contrast, the condition which is represented by the curve $a_2$ offers a significant degree of uniformity. Moreover, comparing the curves $a_2$ and $b_2$ in the second quadrant, it will be seen that the curve $a_2$ is easy to obtain high density images despite the relatively low potentials. Such advantageously suppresses noise at the time of separation of the paper 42 from the photoconductive element 32, while enhancing the developing ability.

The curves $a_3$ and $b_3$ in the third quadrant of FIG. 5 shift themselves when the DC voltage Vo from the power source 54 is changed. For example, as the voltage Vo is raised, the curve $a_3$, $b_3$ shifts toward the smaller lower light quantity side (downwardly in the graph); as the former is lowered, the latter shifts to the larger light quantity side (upwardly in the graph). Also entailed by the increase in the voltage Vo is the increase in the peak of the surface potential Vs on the paper 42. However, where the voltage Vo is excessively low such as 500 volts, the curve in the third quadrant appears as represented by a curve $c_3$ of FIG. 6, which does not correspond to the curve $a_3$ at any portion. Further, in such a situation, the exposing light quantity [log E] to surface potential [Vs] characteristic is not determined by a single condition. For example, even though the quantity of exposing light may be the same, the saturation potential shifts as indicated by an arrow in FIG. 6 if the duration of exposure is longer (that is, the quantity of radiation is small).

Hence, the characteristic represented by the curve $a_2$ in the second quadrant of FIG. 5 is not always presented in all the possible conditions. In the illustrative experiment, for example, such a characteristic was generally not observed when the voltage Vo was about 500 volts, except for some situations wherein the exposing time was long, and was observed at the voltages Vo of 600–700 volts. As to voltages higher than 700 volts, sufficient characteristics have not been determined yet due to the leak at the electrode portions. Another factor to which the characteristic concerned is susceptive, although insignificant, is the variation in the pressure force derived from the weight, and the characteristics of the photoconductive element 32 as well as those of the paper 42. Nevertheless, characteristics essentially similar to those of the second quadrant were accomplished with commercially available various kinds of electrostatic recording papers and with plain papers for use with ordinary copiers (e.g. Ricoh TYPE 6200).

As described above, in accordance with the present invention, a positive electrostatic image is obtainable on the dielectric layer 44 by applying more than a certain quantity of light at the exposing step and, hence, a positive image is achieved without resorting to the difficult inversion development. Concerning the example of FIG. 5, if the quantity of exposing light substantially lies in the range of $5\times10^{-5}$ to $4\times10^{-3}$ [J/cm$^2$], the resulting images will have sufficient gradations. Further increasing the quantity of light, although somewhat reduces the gradations, will constitute effective means for preventing contaminations and others on a document from being reproduced together with images.

Meanwhile, where a light image is projected in a quantity of light which lies in a range of $0\text{–}5\times10^{-5}$ [J/cm$^2$], a negative electrostatic image may be provided on the dielectric layer 44. It should be noted, however, that the specific numerical values, $0\text{–}5\times10^{-5}$ [J/cm$^2$] or $5\times10^{-5}$ to $4\times10^{-3}$ [J/cm$^2$], are not limitative and may be varied depending upon the characteristics of materials used, DC voltage for contact exposure, pressure force, and other conditions.

Figures 7A, 7B, 7C, 7D:
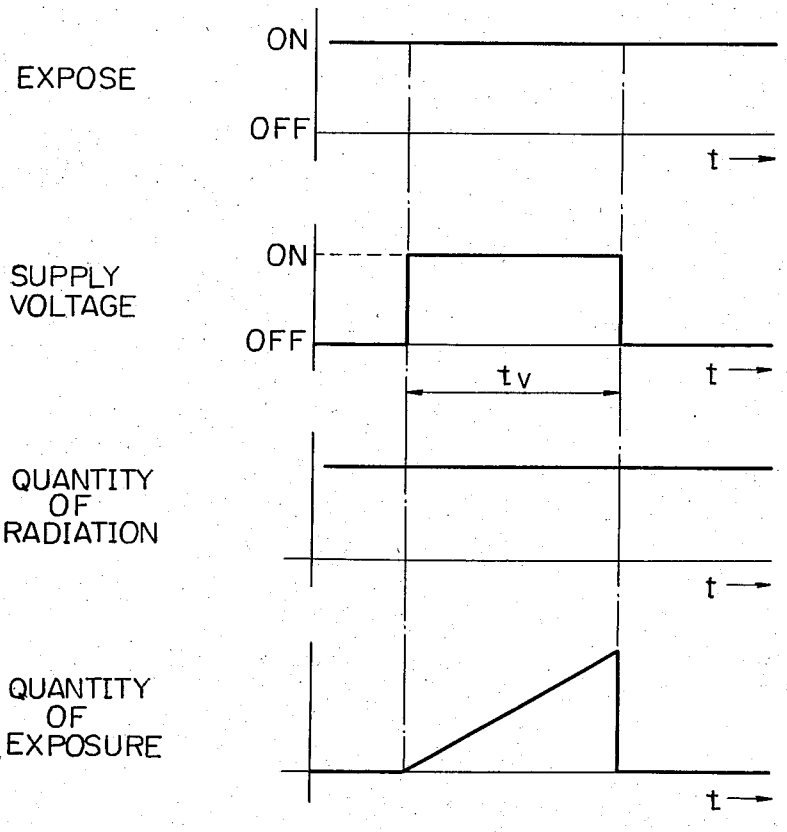
FIGS. 7A–7D are timing charts demonstrating the operation in accordance with the present invention.
Figure 8:
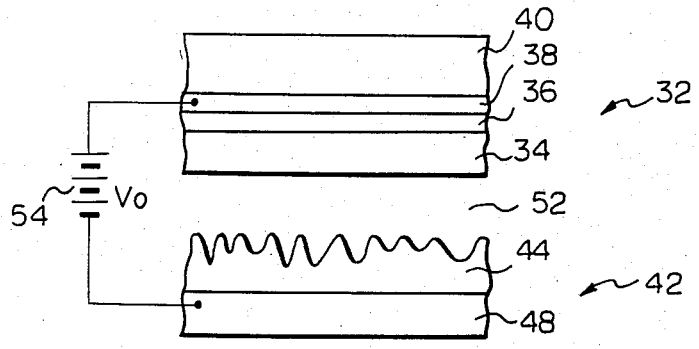
FIG. 8 is a section which models a photoconductive element and an electrostatic recording paper.

Therefore, a positive or a negative electrostatic image is attainable as desired by selecting either a large quantity or a small quantity of radiation using suitable switching means. The switching means may be associated with the amount of radiation from the light source, the distance of the light source, exposing time (duration of application of DC voltage), opening of a stop or the like, or may be implemented with replacement of the neutral filter. Since an electrostatic image is formed only when exposure is effected under the application of a DC voltage, the quantity of exposing light may be expressed as (quantity of radiation)×(duration of DC voltage application). It will thus be seen that, assuming that the quantity of radiation from the light source is constant while constant exposure is under way as shown in FIG. 7, a change in the duration of DC voltage application $t_v$ as shown in FIG. 7B entails a change in the quantity of exposing light as shown in FIG. 7D, thereby allowing a positive or a negative electrostatic image to be formed as desired. In light of this, the present invention contemplates to change the kind of the electrostatic image by switching the duration $t_v$. For example, where the quantity of radiation is kept constant at 0.18 [mW/cm$^2$] and a DC voltage Vo of 650 volts is applied for a duration $t_v$ of 60 seconds, the quantities of exposing light log E as represented by the line $a_4$ of FIG. 5 are set up and, eventually, a positive electrostatic image is produced according to the characteristics $a_1$–$a_4$. Conversely, where the duration $t_v$ is reduced to 0.4 second, quantities of exposing light log E as represented by the line $b_4$ of FIG. 5 are set up with the result that a negative electrostatic image is produced according to $b_1$–$b_4$. The duration of DC voltage application which suffices for ordinary documents does not have to be longer than about 0.25 second for a negative electrostatic image and 20 seconds for a positive electrostatic image. Where the duration of voltage application is 5 seconds, the required quantity of radiation is 0.01 [mW/cm$^2$] for a negative electrostatic image and 0.8 [mW/cm$^2$] for a positive electrostatic image. Furthermore, the quantity of exposing light may be controlled in three or more steps to allow the electrostatic image to be finely adjusted, as will be understood from the characteristics of FIG. 5. Such an alternative exposing step, coupled with the subsequent steps, will enable the image quality to be delicately adjusted.

In any case, the alternative quantities of exposing light allows a positive or a negative electrostatic image to be produced from a positive document or a positive or a negative electrostatic image from a negative document as desired. In short, any desired image is achievable with greater freedom depending upon the document used, application and other conditions.

Figure 9:
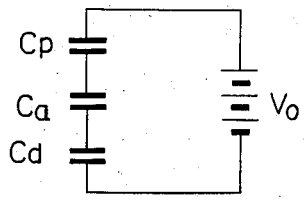
FIG. 9 is an equivalent circuit associated with FIG. 8.

Now, a presumable mechanism which generated the curves $a_2$ and $b_2$ shown in the second quadrant of FIG. 5 will be described. The photoconductive element 32, air gap 52 and recording paper 42 shown in FIG. 8 may be regarded as a serial capacitor model having capacitances Cp, Ca and Cd, respectively, as shown in FIG. 9. Assume a situation wherein the quantity of exposing light is sequentially increased under the application of a constant DC voltage V from the voltage source 54.

(a) When exposing light is absent or, if not absent, small in quantity

Figure 10A:
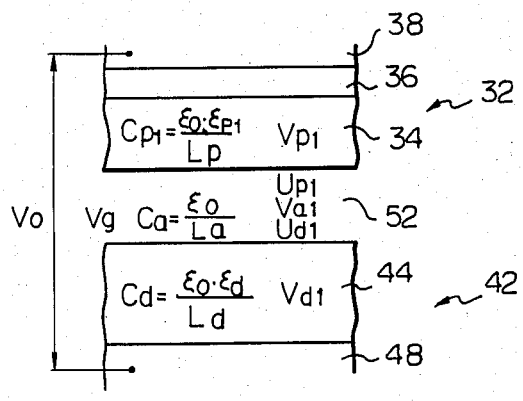
FIGS. 10A–10C are sections representative of different behaviors resulting from different quantities of exposing light.

First, the DC voltage Vo is divided and applied to the various layers. The voltage applied to each of the layers is calculated as (total capacitance)·(DC voltage)/(capacitance of the layer). As shown in FIG. 10A, assume that $Cp_1=\epsilon o\cdot\epsilon p_1/Lp$, $Ca=\epsilon o/La$, and $Cd=\epsilon o\cdot\epsilon d/Ld$. Then, the total capacitance $Co_1$ is produced by:

$$C_{01}=\left(\frac{1}{Cp_1}+\frac{1}{Ca}+\frac{1}{Cd}\right)^{-1}$$

The voltages $Vp_1$, $Va_1$ and $Vd_1$ applied to the respective layers are expressed as:

$$Vp_1=\frac{Co_1}{Cp_1}\cdot Vo$$

$$Va_1=\frac{Co_1}{Ca}\cdot Vo$$

-continued $$Vd_1 = \frac{Co_1}{Cd} \cdot Vo$$

Here, Ca and Cd are each assumed to be constant with respect to $E=Eo\times t$. Lp, La and Ld are indicative of thicknesses of the respective layers.

At this instant, if the divided voltage $Va_1$ in the air gap 52 is equal to or lower than the Paschen's spark start voltage Vg, discharge does not occur. Then, both the surface potential $Up_1$ of the photoconductive element 32 and the surface potential $Ud_1$ of the recording paper 42 are zero and, hence, no charge remains on the paper 42 after the separation of the photoconductive element 32 and the paper 42.

(b) When exposing light is increased

Figure 10B:
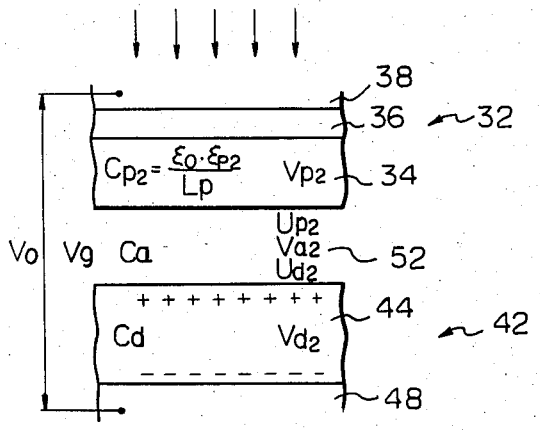

In this case, the capacitance of the photoconductive element 32 is assumed to be $Cp_2=\epsilon o\cdot\epsilon p_2/Lp$ as shown in FIG. 10B. From this, the total capacitance is expressed as:

$$C_{02} = \left(\frac{1}{Cp_2} + \frac{1}{Ca} + \frac{1}{Cd}\right)^{-1}$$

Therefore, the voltages $Vp_2$, $Va_2$ and $Vd_2$ are produced as:

$$Vp_2 = \frac{Co_2}{Cp_2} \cdot Vo$$

$$Va_2 = \frac{Co_2}{Ca} \cdot Vo$$

$$Vd_2 = \frac{Co_2}{Cd} \cdot Vo$$

Concerning a photoconductive element, particularly the element 32 constructed and arranged in accordance with the present invention, as the quantity of exposing light is increased in the case (b), the charge migrates through the charge transfer layer 34 due to the quantum effect associated with the increased quantity of exposing light, resulting in a drop of the voltage $Vp_2$ applied to the element 32. This may safely be translated into an increase in the capacitance Cp or the dielectric constant $\epsilon p$ of the element 32. That is, there holds relationships $Cp_1<Cp_2$ and $\epsilon p_1<\epsilon p_2$. Since the DC voltage Vo is the same, The voltage $va_2$ becomes higher than the voltage $Va_1$ to increase the voltage in the air gap 52 until $Va_2>Vg$ holds. As a result, discharge occurs between the photoconductive element 32 and the paper 42 based on the voltage increase $Uo_2=Va_2-Vg$. This divides the surface potential $Up_2$ of the element 32 and the surface potential $Ud_2$ of the paper 42 by the capacitances as follows:

$$Up_2 = \frac{Cd}{Cp_2 + Cd} \cdot Uo_2$$

$$Ud_2 = \frac{Cp_2}{Cp_2 + Cd} \cdot Uo_2$$

Charges associated with those surface potentials $Up_2$ and $Ud_2$ are deposited on the surfaces of the element 32 and paper 42, respectively. In this case, since the voltage Va in the air gap 52 increases with the increase in the quantity of exposing light, a negative electrostatic image or a negative image is produced as represented by $b_1$–$b_4$ in FIG. 5.

(c) When exposing light is further increased

Figure 10C:
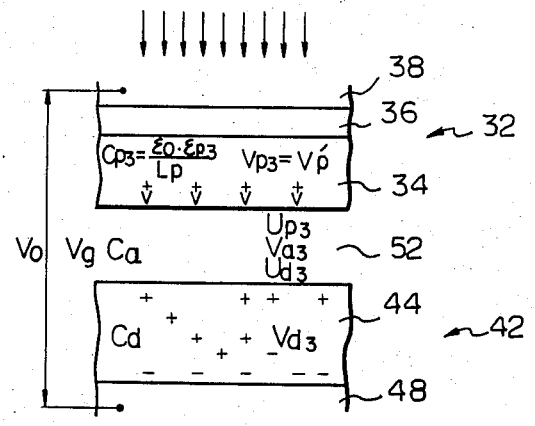

First, as shown in FIG. 10C, the capacitance of the photoconductive element 32 is determined as $Cp_3=\epsilon o\cdot\epsilon p_3/Lp$. Then, the total capacitance $Co_3$ is expressed as:

$$C_{03} = \left(\frac{1}{Cp_3} + \frac{1}{Ca} + \frac{1}{Cd}\right)^{-1}$$

Further increasing the quantity of exposing light by increasing the exposing time causes the charges in the paper 42, particularly those at the interface of the electrode layer 44, to migrate as shown in FIG. 10C. At this instant, if any microscopic irregularity exists in the charge density, the whole charges are uniformalized (the irregularity is reduced). In the element 32, on the other hand, charge trap occurs in the charge transfer layer 34 or at its interface as shown in FIG. 10C, with the result that the voltage Vp applied to the element 32 is gradually increased. This in turn lowers the voltage Va applied to the air gap 52. For these reasons, the surface potential Ud which the charges stored in the paper 42 after separation shows to the outside begins to decrease with the increase in the quantity of exposing light. That is, a positive electrostatic image having such a tendency that the surface potential or the amount of surface charge is comparatively small in an area wherein the quantity of light is comparatively large. As a result, presumably, the positive electrostatic image or the positive image is presented as represented by $a_1$–$a_4$ of FIG. 5.

The above occurrence will be explained using equations. Assuming that the voltage $Vp_3$ associated with the photoconductive element 32 which increases with the exposing light is equal to V'p, then the voltage $Va_3$ associated with the air gap 52 and that $Vd_3$ associated with the paper 42 are produced by:

$$Va_3 = \frac{Co_3}{Ca}(Vo - Vp')$$

$$Vd_3 = \frac{Co_3}{Cd}(Vo - Vp')$$

For correspondence with the above equations, the voltage $Vp_3$ may be expressed as follows, using a voltage $V_F$:

$$Vp_3 = Vp' = \frac{Co_3}{Cp_3}(Vo - Vp') + V_F$$

Initially, because the voltage $Va_3$ is higher than the Paschen's sparking voltage Vg, discharge takes place based on the fragment $Uo_3=Va_3-Vg$ as has been described in relation to the case (b). As a result, the surface potentials $Up'_3$ and $Ud'_3$ of the element 32 and paper 42 attain respectively the following values:

$$Up_3' = \frac{Cd}{Cp_3 + Cd} \cdot Uo_3$$

$$Ud_3' = \frac{Cp_3}{Cp_3 + Cd} \cdot Uo_3$$

As the quantity of exposing light is further increased as above stated, the surface potentials change respectively to $Up_3$ and $Ud_3$ as shown below:

$$Up_3 = \frac{Cd}{Cp_3 + Cd} \cdot Uo_3 + V_F$$

$$Ud_3 = \frac{Cp_3}{Cp_3 + Cd} \cdot Uo_3 - \frac{Z}{Ld}$$

where Z is the distance between positive (+) and negative (−) charges, and Z is smaller than Ld.

It will be seen from the above that a positive electrostatic image is obtainable by applying more than a certain quantity of exposing light during an exposing step. However, in the case where the quantity of exposing light inclusive of reflections from a document and flares is extremely small or where the document is transmissive and both its transmission and the quantity of exposing light are extremely small, hardly any electrostatic image can be formed in the associated portions. These particular portions are substantially void of charge or potential as those portions in which the quantity of exposing light has been extremely large are and, therefore, undistinguishable from the latter. While further increasing the quantity of radiation as a light image will be a solution to such a problem, it brings about various disadvantages concerning electrostatic image forming conditions.

Figure 11A:
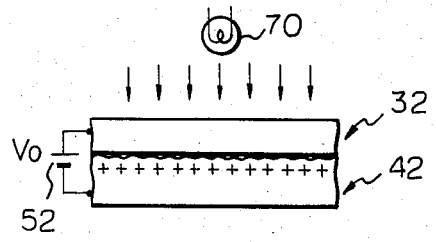
FIGS. 11A–11E are sections of a photoconductive element and an electrostatic recording paer which show consecutive stages of operation in accordance with the present invention.
Figure 11B:
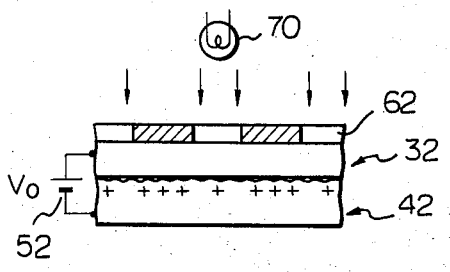
Figure 11C:
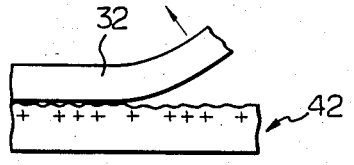
Figure 11D:
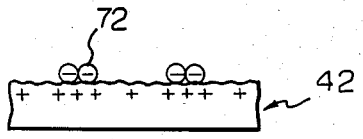
Figure 11E:
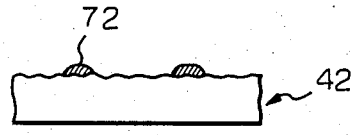

The present invention solves the above problem by procedures which are shown in FIGS. 11A and 11B. Specifically, as shown in FIG. 11A, full-surface exposure is effected by the light source 70 with the DC voltage Vo from the voltage source 52 applied. This is followed by exposure to a light image, as shown in FIG. 11B. While the line $a_4$ shown in FIG. 5 implies that a positive electrostatic image is obtainable by selecting a quantity of exposing light of $5\times10^{-5}$ to $4\times10^{-3}$ [J/cm$^2$], it will also be understood from FIG. 5 that the quantity of light of $5\times10^{-5}$ [J/cm$^2$] is the minimum amount of light necessary for all the regions with no regard to light images (light and dark document images). Hence, in accordance with the present invention, full-surface exposure with a quantity of exposing light of, for example, $5\times10^{-5}$ [J/cm$^2$] is effected at the step of FIG. 11A and, then, exposure with a quantity of exposing light of, for example, $0\text{–}4\times10^{-3}$ [J/cm$^2$] at the step of FIG. 11B; the total quantity of exposing light is large enough to set up the characteristic as represented by the curve $a_3$ of FIG. 5. After the electrostatic image has been formed, the element 32 and he paper 42 are separated from each other as shown in FIG. 11C, then the electrostatic image is developed by toner 72 as shown in FIG. 11D, and then the toner image is fixed as shown in FIG. 11E.

While the full-surface exposure (FIG. 11A) has been shown and described as being effected prior to the exposure to a light image (FIG. 11B), it will readily occur to those skilled in the art that the former may be performed after the latter because the curve $a_3$ shown in the third quadrant of FIG. 5 is representative of an electrostatic image characteristic which is dependent upon the quantity of exposing light. The steps of FIGS. 11A and 11B may be performed either continuously without interrupting the supply of the DC voltage Vo or discontinuously by temporarily interrupting it.

Figure 12:
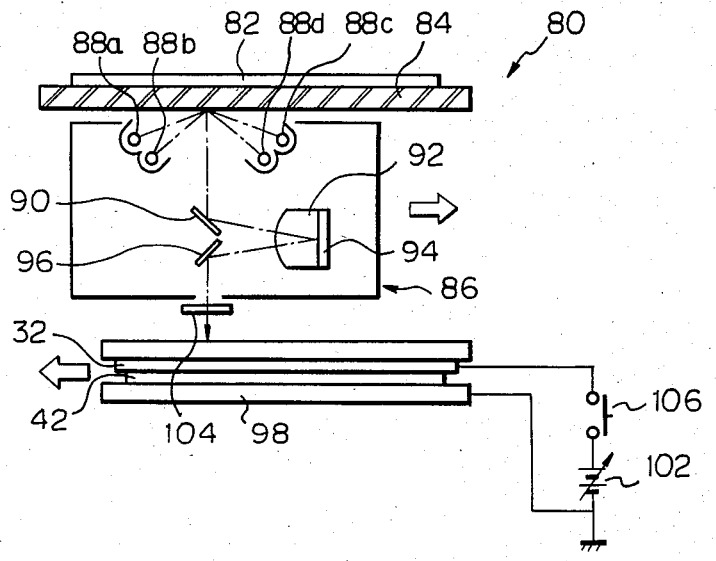
FIG. 12 is a schematic side elevation of an image forming apparatus to which the present invention is applied.

Referring to FIG. 12, an apparatus 80 to which the present invention is applied is shown. An ordinary document 82 is laid on a glass platen 84. An imaging unit 86 having four lamps 88*a*–88*d*, a first mirror 90, a lens 92, a mirror 94 and a mirror 96 is driven as indicated by an arrow to scan the document 82. In the illustrative arrangement, the lamps 88*a*–88*d* are each about 220 millimeters in length and 500 watts in power. A table 98 which bifunctions as an electrode is loaded with the recording paper 42 and the photoconductive element 32 which are held in intimate contact with each other. A sheet glass 100 is placed on the element 32 and biased by a spring or the like (not shown) to further enhance the intimate contact between the paper 42 and the element 32. The element 32 is half-fixed to the sheet glass 100, while the electrode layer 38 of the element 32 is pressurized against an electrode which is positioned at an end of the glass sheet 100 to be electrically connected therewith. The table 98 is connected to a DC power source 102 and movable as indicated by an arrow carried by a wire or the like.

In the above construction, a light image issuing from the imaging unit 86 is projected through a variable slit 104 onto the table 98. As soon as the table 98 reaches a predetermined leftward position in FIG. 12, a switch 106 is actuated to interrupt the DC power supply so that the paper 42 carrying an electrostatic image may be manually taken out of the apparatus. Upon completion of all the consecutive steps, the imaging unit 86 and the table 98 are returned to their original or home positions to prepare for another imaging cycle.

In detail, to produce a positive electrostatic image from the document 82, the operation begins with turning on all the four lamps 88*a*–88*d* and moving the imaging unit 86 and the table 98 in the previously mentioned directions at a relative speed of about 1 millimeters per second. The variable slit 104 is about 30 millimeters wide when fully opened and controllable to a narrower width for fine adjustment of the quantity of light as desired. On the other hand, to produce a negative electrostatic image from the document 82, only two, 88*a* and 88*c*, of the four lamps are turned on for exposure. The imaging unit 86 and the table 98 are moved at a relative speed of 20 millimeters per second this time. Again, the width of the slit 104 is controllable to finely adjust the amount of light. Since the imaging unit 86 as a whole entails several percent of flare, the apparatus 80 is so constructed as not to allow any unexposed portion to remain on the table 98 during the course of positive electrostatic image forming procedure.

As stated above, the positive or a negative electrostatic image is obtainable as desired by changing the quantity of exposing light, that is, by applying a larger quantity of exposing light in the case of a positive electrostatic image than in the case of a negative one. This at the same time may undesirably add to the period of time necessary for an electrostatic image to be formed and/or to the energy consumption and heat generation by the light source. The present invention also proposes an implementation for settling such a situation, paying attention to the value of the DC voltage.

Figure 13:
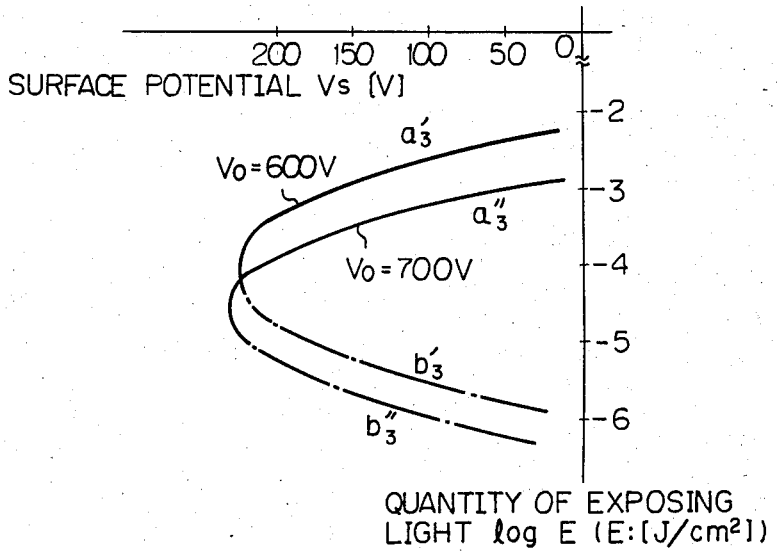
FIG. 13 shows characteristic curves which respectively are associated with different DC voltages.

Restudying the curve $a_3$, $b_3$ in the third quadrant of FIG. 5, a characteristic represented by a curves $a'_3$, $b'_3$ as shown in FIG. 13 was obtained when the DC voltage Vo was 600 volts, and a characteristic represented by a curve $a''_3$, $b''_3$ when it was increased to 700 volts. As shown in FIG. 13, the characteristic curve shifts itself toward the smaller exposing light quantity side as the DC voltage Vo is raised. It follows that for a given image, raising the DC voltage Vo reduces the required quantity of exposing light and, thereby, increases the process sensitivity. Utilizing this fact, a positive electrostatic image is formed by controlling the DC voltage Vo to 700 volts to use the curve $a''_3$, while a negative electrostatic image is formed by switching it to 600 volts to use the curve $b'_3$. Although switching the DC voltage to the higher one even for a negative electrostatic image may be contemplated, such is undesirable because constantly locking the voltage to the higher one increases energy consumption and because the electric field of the photoconductive layer of the element 32 is intensified to promote fatigue of the element 32. In short, since the improvement in process sensitivity does not sufficiently work for a negative electrostatic image, the present invention sets up the higher DC voltage only at the time of forming a positive electrostatic image.

Figure 14:
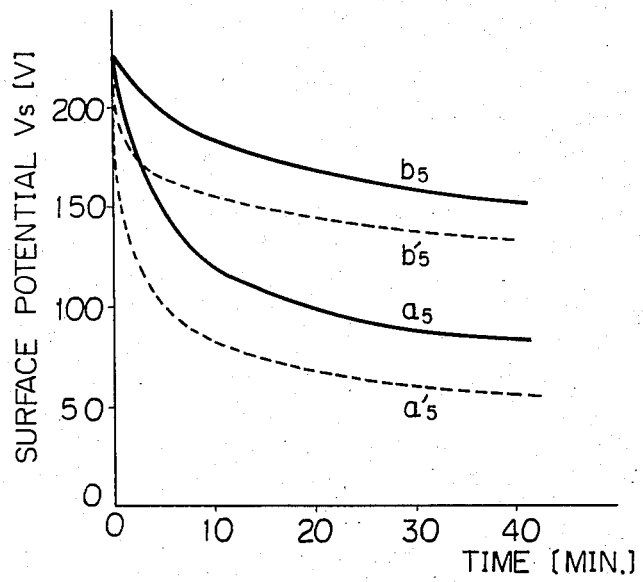
FIG. 14 shows a characteristic curve representative of attenuation of surface potential.

Meanwhile, in accordance with the present invention, based on the finding that even the same potentials attenuate in different manners in dependence upon the quantity of exposing light to reach entirely different values, a predetermined period of time for adaption is provided. Turning back to FIG. 5, at the time of forming a positive electrostatic image, it is necessary to project a light image within the range of, for example, $5\times10^{-5}$ to $4\times10^{-3}$ [J/cm$^2$] as previously stated. Such particular quantities of light set up a potential contrast of about 230 volts, as understood from the third quadrant. Assume two points Pa and Pb in the third quadrant which are defined at opposite sides of the peak of the curve $a_3$, $b_3$ and each shows a surface potential of about 220 volts. comparision of those two points Pa and Pb with respect to the manner of potential attenuation provided the characteristics which are shown in FIG. 14. In FIG. 14, the quantity of exposing light is $1.15\times10^{-4}$ [J/cm$^2$] at the point Pa and $2.2\times10^{-5}$ [J/cm$^2$] at the point Pb. Solid curves $a_5$ and $b_5$ in FIG. 14 are representative of adaptation effected in a condition in which an electric field is absent, the curve $a_5$ being associated with the point Pa and the curve $b_5$ with the point Pb. The dotted curves $a'_5$ and $b'_5$, on the other hand, are representative of adaptation effected in an electric field of 170 volts per centimeter, the curve $a'_5$ being associated with he point Pa and the curve $b'_5$ with the point Pb.

Figure 15:
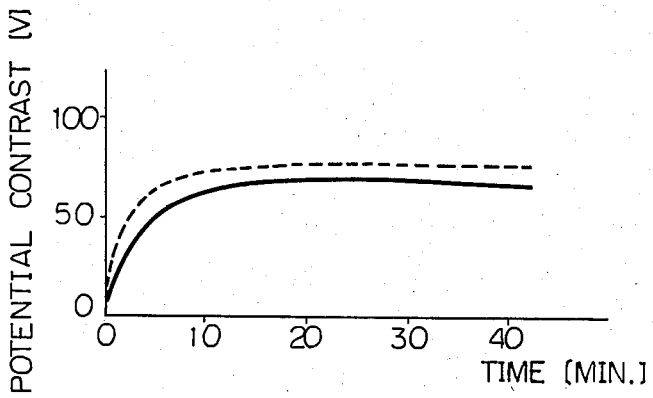
FIG. 15 shows a characteristic curve representative of potential contrast.

It will seen from FIG. 14 that even if the initial potential is the same, any difference in the quantity of exposing light causes the potential to attenuate in different manners during adaptation and, after several minutes, sets up entirely different potentials. Especially, as represented by the curves $a_5$ and $a'_5$, a greater quantity of exposing light causes the potential to attenuate faster so that eventually a substantial potential contrast is observed between the curves $b_5$ and $b'_5$, as shown in FIG. 15. It will also be seen that such phenomena are accelerated by an external electric field as well. In this manner, the difference in attenuation characteristic is presumably accounted for by the occurrence that even if the potential may be the same, the position of a charge depends upon the quantity of exposing light and, especially, the distance between positive charges and that between negative charges are reduced when the quantity of light is greater, thereby accelerating the attenuation during adaptation.

For the above reason, where a light image is projected within the range of $1.15\times10^{-4}$ to $2.2\times10^{-5}$ [J/cm$^2$], an electrostatic image initially formed on the dielectric layer 44 has a potential contrast as great as 220 to 230 volts and is generally short of a uniform image. In contrast, several minutes of adaptation time in accordance with the present invention makes it possible to form an electrostatic image having a potential contrast of about 40 to 80 volts, as shown in FIG. 15. The adaptation time will especially be shortened if the adaptation is effected in an electric field. Alternatively, the formed electrostatic image may be positive electrostatic image because a greater quantity of exposing light sets up a lower potential.

In short, in accordance with the present invention, a positive electrostatic image is achievable with a medium quantity of exposing light such as $1.15\times10^{-4}$ to $2.2\times10^{-5}$ [J/cm$^2$] instead of a large one such as $5\times10^{-5}$ to $4\times10^{-3}$ [J/cm$^2$], so that desirable image forming conditions can be established. Further, even the characteristic $C_3$ of FIG. 6 which develops just after the formation of an electrostatic image is capable of setting up a potential contrast associated with the quantity of exposing light when provided with an adaptation time as in the present invention, enabling a positive image to be formed. In this regard, too, the adaptation time leads to more desirable imaging forming conditions.

As described above, in accordance with the present invention, the photoconductive element 32 is provided with transmissivity and exposed to a light image from the back to inject light into the charge generation layer 36. The ratio in quantity between the light injection into the layer 36 to the exposing light was measured to be aout 35%. It is permissible to provide the paper 42, instead of the element 32, with transmissivity and to turn the element 32 and paper 42 shown in FIG. 2 upside down so that light may be projected from the back of the paper 42. While in such an alternative arrangement it is difficult to increase the transmission of the paper 42, particularly its dielectric layer 44, and the injection efficiency of light into the layer 36 of the element 32 becomes poor, a characteristic similar to that of FIG. 5 is attainable only if the same quantity of light as in the illustrative embodiment is injected, thereby enhancing the freedom of system construction.

The electrostatic recording paper which has been shown and described as a recording medium may be replaced with a plain paper or like paper, cloth, plastics, film or any other dielectric sheet. Even such an alternative sheet is capable of forming a positive electrostatic image thereon if used in intimate contact with an electrode, which is provided on the back of the sheet as a separate member. Generally, however, such an alternative material is limited in capacitance due to its thickness and, therefore, in the voltage in the air gap. This undesirably lowers the resulting image density and requires DC voltage Vo to be raised. For example, when the method of the present invention was practiced using the previously mentioned paper TYPE 6200, the resulting image density was not greater than about 0.3.

It will readily occur to those skilled in the art that the transmissive document shown and described as a document may be replaced with an ordinary document, in which case reflections from the document may be projected as in a copier.

As described hereinabove, a method of the present invention projects a light image having a light quantity region greater than a predetermined quantity of exposing light and, hence, allows a positive electrostatic image to be formed on a dielectric layer of a recording medium with a particular tendency that the surface potential or the amount of surface charge is comparatively small in a region in which the quantity of light is comparatively large. In addition, full-surface exposure is performed before or after exposure to a light image using a predetermined quantity of light such that the total quantity of light becomes greater than a predetermined one. Such further enhances stable formation of a positive electrostatic image and eliminates the need for inversion development and, thereby, promotes free manipulation of ordinary document, instead of negative documents.

Further, in accordance with the present invention, a plurality of quantities of light are selectively set up so that a positive or a negative electrostatic image may be provided depending upon the selected quantity of light, that is, the duration of DC voltage supply during exposure is changed to provide either a positive electrostatic image or a negative one. An electrostatic image, whether it be positive or negative, can thus be formed as desired using the same document. Stated another way, any of the images can be freely obtained to meet a particular kind of document, application, etc.

In addition, the method of the present invention does not immediately develop an electrostatic image which is provided on a dielectric layer and, instead, waits until a predetermined period of time for adaptation expires. This enables a positive electrostatic image to be formed without resorting to a large quantity of exposing light, thereby promoting image forming cycles under advanatageous conditions.

Various modifications will become possible for those skilled in the art after receiving the teachings of the present disclosure without departing from the scope thereof.

What is claimed is:

1. An electrostatic image forming method for an image forming apparatus, said apparatus being provided with a photoconductive element having an electrode layer and a photoconductive layer, and a recording medium having at least a dielectric layer, at least one of the photoconductive element and the recording medium having transmissivity, said method comprising the steps of:

(a) causing the photoconductive layer of the photoconductive element and the dielectric layer of the recording medium to face and make close contact with each other with the intermediary of an air gap;

(b) applying a DC voltage across the electrode layer of the photoconductive element and the dielectric layer of the recording medium;

(c) projecting a light image for exposure from a back of one of the photoconductive element and the recording medium which has transmissivity; and (d) controlling a light quantity of the light image; whereby a positive electrostatic image or a negative electrostatic image is formed on the dielectric layer of the recording medium.

2. A method as claimed in claim 1, wherein the step (d) comprises (e) projecting a light image having a light quantity region which is greater than a predetermined quantity of exposing light.

3. A method as claimed in claim 1, wherein the step (d) comprises (e), prior to the step (c), performing full-surface exposure to a predetermined quantity of exposing light while applying a DC voltage across the electrode layer of the photoconductive element and the dielectric layer of the recording medium.

4. A method as claimed in claim 1, wherein the step (d) comprises (e), after the step (c), performing full-surface exposure to a predetermined quantity of exposing light while applying a DC voltage across the electrode layer of the photoconductive element and the dielectric layer of the recording medium.

5. A method as claimed in claim 1, wherein the step (d) comprises (e) presetting a plurality of quantities of exposing light and (f) selecting one of the present quantities of exposing light, whereby a positive or a negative electrostatic image is formed depending upon the selected quantity of exposing light.

6. A method as claimed in claim 5, wherein the step (f) comprises (g) changing a duration of application of the DC voltage.

7. A method as claimed in claim 1, further comprising the step of (e) providing a predetermined period of time for adaptation by, before developing the formed electrostatic image, leaving the electrostatic image in a condition in which an electric field is or is not applied.

* * * * *